US005445330A

United States Patent [19]

Shokry Rashwan et al.

[11] Patent Number: 5,445,330

[45] Date of Patent: Aug. 29, 1995

[54] MOBILE CRUSHING PLANT

[75] Inventors: Mohamed M. Shokry Rashwan; Barry Burrows, both of Edmonton, Canada

[73] Assignee: Integrated Construction Engineering Systems Inc., Edmonton, Canada

[21] Appl. No.: 237,157

[22] Filed: May 3, 1994

[51] Int. Cl.[6] ..... B02C 21/02; B02C 23/08

[52] U.S. Cl. ..... 241/78; 241/186.35; 241/DIG. 38

[58] Field of Search ..... 241/76, 78, 101.7, 186.35, 241/DIG. 38, 75

[56] References Cited

U.S. PATENT DOCUMENTS

| | | | |
|---|---|---|---|
| 2,210,093 | 8/1940 | Morrissey | 241/78 X |
| 2,325,719 | 8/1943 | Turner, Jr. | 241/78 |
| 3,647,150 | 3/1972 | Stephanek | 241/75 |
| 4,168,034 | 9/1979 | Leger | 241/76 |
| 4,598,875 | 7/1986 | Bronson et al. | 241/78 |

*Primary Examiner*—Irene Cuda
*Assistant Examiner*—John M. Husar
*Attorney, Agent, or Firm*—Anthony R. Lambert

[57] ABSTRACT

A mobile crushing plant is described which was developed for processing concrete or masonry waste and includes a trailer with a primary crusher mounted on the trailer. The crusher has an inlet and an outlet. A screening assembly is mounted on the trailer. The screening assembly has a screen disposed at an angle such that pieces of waste material too large to pass through the screen roll down the angled screen to a drop off area. A first conveyor extends from the outlet of the primary crusher to above the screen, whereby crushed pieces of waste material exiting through the outlet of the primary crusher are conveyed to the screen. A second conveyor extends from the drop off area adjacent the screen to the inlet of the primary crusher, whereby pieces of waste material too large to pass through the screen are reprocessed through the primary crusher. The mobile crushing plant is intended for on site recycling of concrete and masonry waste resulting from the demolition or construction of a building, by turning the waste material into aggregate which can be mixed with cement to form new concrete.

1 Claim, 2 Drawing Sheets

MOBILE CRUSHING PLANT

The present invention relates to a mobile crushing plant.

BACKGROUND OF THE INVENTION

For both economic and ecological reasons it is viewed as desirable to reclaim and recycle building materials. A large number of buildings are constructed of concrete or masonry construction. It is technically feasible to reclaim concrete or masonry waste during the demolition or construction of a building. The concrete or masonry waste is crushed to form a gravel-like aggregate and then recycled by mixing with minimum amounts of cement and sand. The resulting crushed aggregate is used to form a new concrete building material. Tests performed on the resulting concrete indicate that it is of superior strength. This is viewed as being due to a cement residue in the recycled gravel-like aggregate.

The reclaiming of the large chunks of concrete or masonry waste recovered during the demolition or construction of a building is performed at a crushing plants. These crushing plants consist of a plurality of crushers. The large chunks of concrete or masonry waste are reduced to an appropriate aggregate size as a result of processing through a series of crushers. Each crusher in the crushing sequence is only capable of reducing the size of a chunk of concrete or masonry waste by a set maximum percentage, usually 1/6 to ¼.

The need for processing through a series of crushers has made it difficult for on site processing through the use of a mobile crushing plant. In the absence of mobile crushing equipment capable of processing large chunks of concrete or masonry waste, the concrete or masonry waste must be trucked for processing off site. The transportation costs involved in hauling large chunks of concrete or masonry waste to a remote crushing plant and the recycled aggregate back destroys the economic benefits of recycling.

SUMMARY OF THE INVENTION

What is required is a mobile crushing plant capable of processing large chunks of concrete or masonry waste.

According to the present invention there is provided a mobile crushing plant which includes a trailer with a primary crusher mounted on the trailer. The crusher has an inlet and an outlet. A screening assembly is mounted on the trailer. The screening assembly has a screen disposed at an angle such that pieces of waste material too large to pass through the screen roll down the angled screen to a drop off area. A first conveyor extends from the outlet of the primary crusher to above the screen, whereby crushed pieces of waste material exiting through the outlet of the primary crusher are conveyed to the screen. A second conveyor extends from the drop off area adjacent the screen to the inlet of the primary crusher, whereby pieces of waste material too large to pass through the screen are reprocessed through the primary crusher.

With the mobile crushing plant, as described above, the pieces of concrete or masonry waste are continually recycled through the primary crusher until they reach a size small enough to pass through the screen. This eliminates the need for sequential processing of the concrete or masonry waste through a plurality of crushers.

Although beneficial results may be obtained through the use of the mobile crushing plant, as described above, it is impossible for the primary crusher to perform its intended function and also provide a more precise processing of smaller aggregate. Even more beneficial results may, therefore, be obtained when a top screen and a bottom screen are arranged with the top screen positioned directly above the bottom screen. Small pieces of waste material pass through both screens. Pieces of waste material too large to pass through the bottom screen, and therefore in need of secondary processing, roll down the angled bottom screen to an inlet for a secondary crusher.

Although beneficial results may be obtained through the use of the mobile crushing plant, as described above, the economics of such a crushing plant is dependent upon throughput. Even more beneficial results may, therefore, be obtained when a feed hopper provides a continuous supply of reclaimed concrete or masonry waste to the inlet of the primary crusher.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
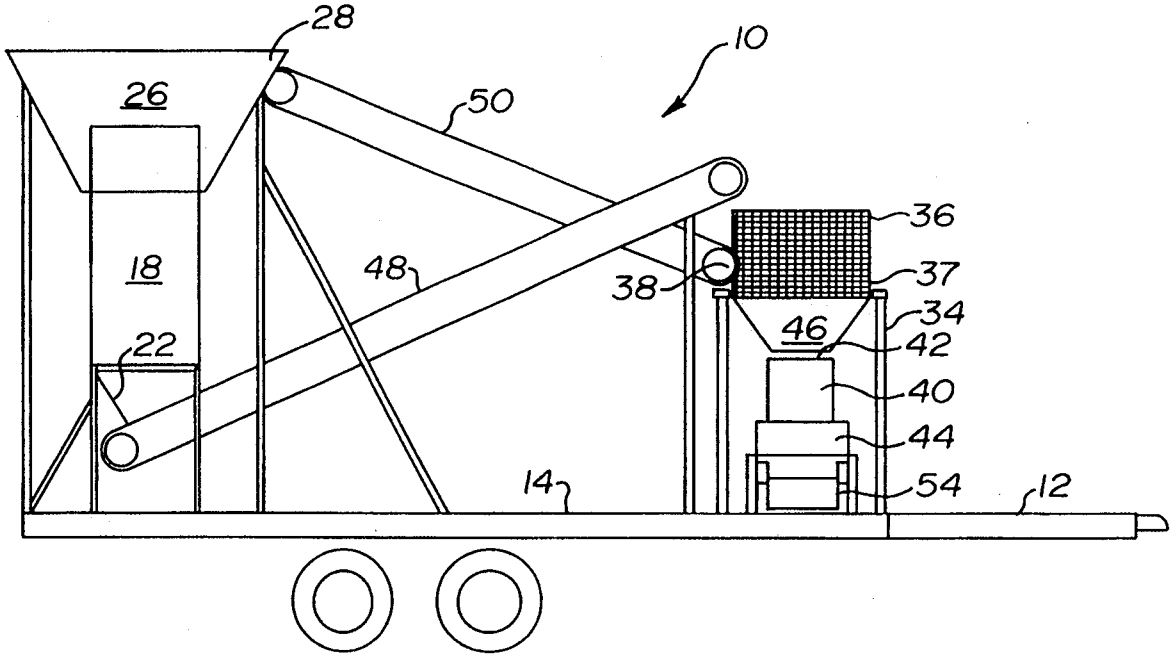
FIG. 1 is a side elevation view of a mobile crushing plant constructed in accordance with the teachings of the present invention.
Figure 2:
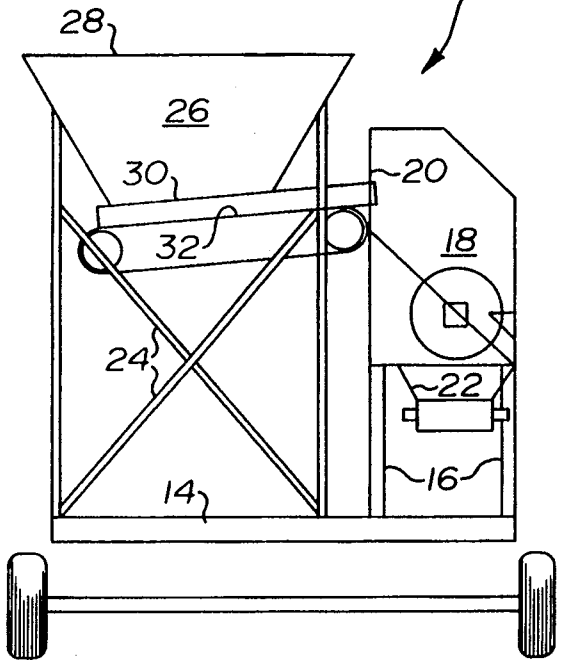
FIG. 2 is an end elevation view of the mobile crushing plant illustrated in FIG. 1.
Figure 3:
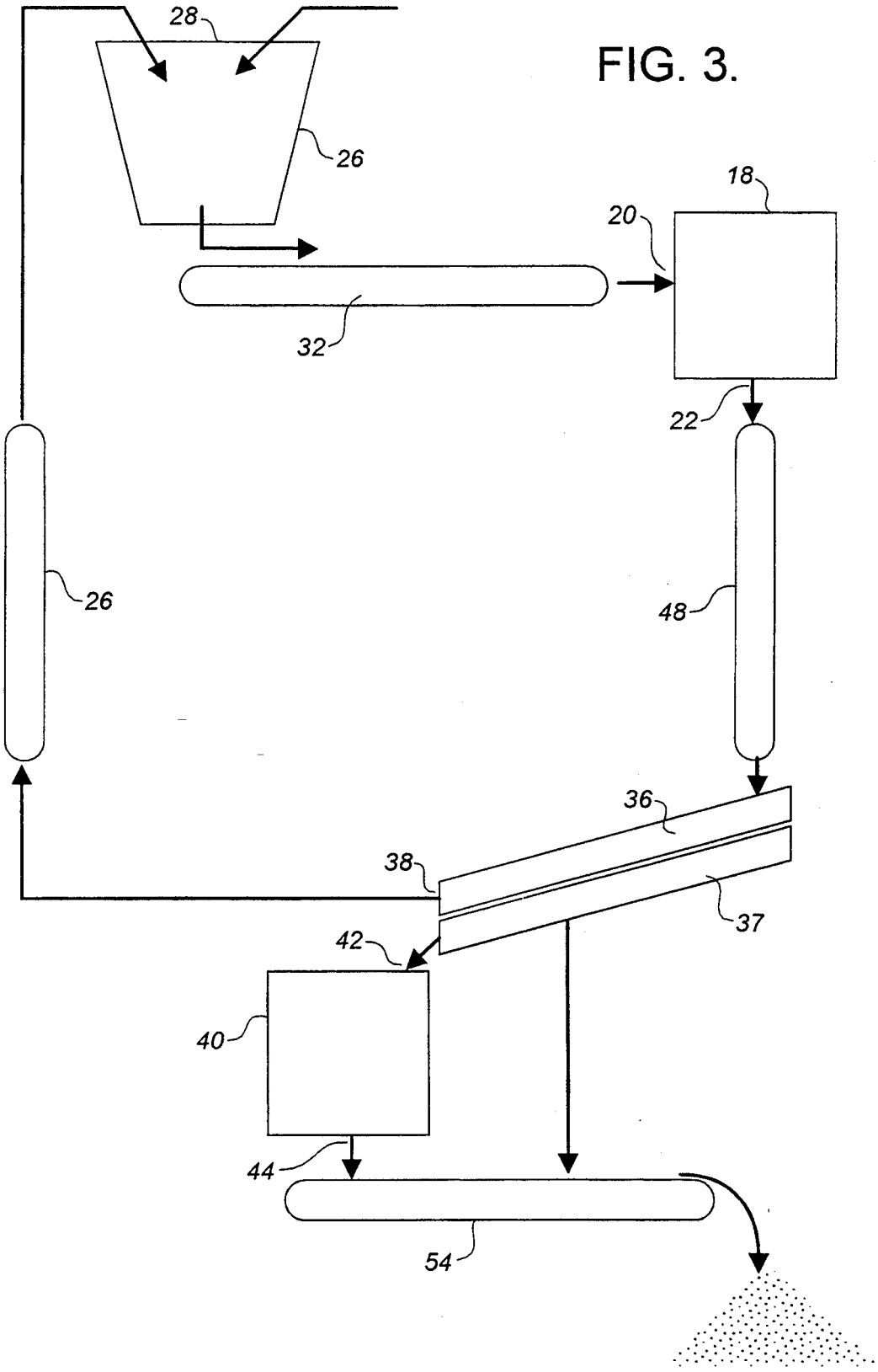
FIG. 3 is flow diagram showing the processing of concrete or masonry waste through the mobile crushing plant illustrated in FIG. 1.

The preferred embodiment, a mobile crushing plant generally identified by reference numeral 10, will now be described with reference to FIGS. 1 through 3.

Mobile crushing plant 10 has a trailer 12 having a deck 14 onto which various components are mounted. A crusher support frame 16 is used to mount a primary crusher 18 to deck 14. Crusher support frame 16 supports primary crusher 18 in an elevated position above deck 14. Primary crusher 18 has an inlet 20 and an outlet 22. A feed hopper assembly 24 is also mounted to deck 14. Feed hopper assembly 24 includes an elevated feed hopper 26 having an inlet 28 and an outlet 30. A feed conveyor 32 extends from outlet 30 of feed hopper 26 to inlet 20 of primary crusher 18. A screening assembly support frame 34 is secured to deck 14. Screening assembly support frame 34 includes two screens 36 and 37 mounted in an elevated position above deck 14 and at a steep angle, such that pieces of concrete or masonry waste too large to pass through top screen 36 will roll down the angled screen to a drop off area, generally designated by reference numeral 38. A secondary crusher 40 is mounted to deck 14. Secondary crusher 40 has an inlet 42 and an outlet 44. Pieces of concrete or masonry waste too large to pass through bottom screen 37 roll down the angled screen to inlet 42 of secondary crusher 40 for secondary processing. Screening assembly support frame 34 has inwardly angled depending deflectors 46. Deflectors 46 direct pieces of concrete or masonry waste small enough to pass through both top screen 36 and bottom screen 37 onto an output conveyor 54. The output from outlet 44 of secondary crusher 40 falls onto output conveyor 54, where is carried to a collection area (not shown). A first conveyor 48 extends from outlet 22 of primary crusher 18 to above screen 36. Conveyer 48 conveys crushed pieces of concrete or masonry waste exiting through outlet 22 of primary crusher 18 to screen 36. A second conveyor 50 extends from drop off area 38 to inlet 28 of feed hopper 26. Second conveyor 50 conveys pieces of concrete or masonry waste too large to pass through screen 36 and which drop off screen 36 into drop off area 38 to inlet 28 of feed hopper 26.

The use and operation of mobile crushing plant 10 will now be described with reference to FIGS. 1 through 3. A tractor equipped with a front end loader will constantly be dumping large pieces of reclaimed concrete or masonry waste into inlet 28 of feed hopper 26. This ensures that a continuous supply of reclaimed concrete or masonry waste will be fed via feed conveyor 32 to inlet 20 of primary crusher 18. Conveyer 48 conveys crushed pieces of concrete or masonry waste exiting through outlet 22 of primary crusher 18 to top screen 36. Deflectors 46 direct pieces of concrete or masonry waste small enough to pass through both top screen 36 and bottom screen 37 onto an output conveyor 54. Pieces of concrete or masonry waste too large to pass through top screen 36 roll down the angled screen to a drop off area, generally designated by reference numeral 38. Second conveyor 50 conveys pieces of concrete or masonry waste too large to pass through screen 36 and which drop off screen 36 into drop off area 38 to inlet 28 of feed hopper 26. Large pieces of concrete or masonry waste may have to pass through primary crusher 18 several times until they are reduced to a size small enough to pass through screen 36. Pieces of concrete or masonry waste small enough to pass through top screen 36, but too large to pass through bottom screen 37 roll down the angled screen to inlet 42 of secondary crusher 40 for secondary processing. The processed pieces of concrete or masonry waste exiting outlet 44 of secondary crusher 40 onto output conveyor 54, where is carried to a collection area (not shown). The waste material that reaches output conveyor 54 is aggregate suitable for mixing with cement for use in forming new concrete. This new concrete tends to be stronger than concrete made with non-recycled sand and gravel; this is presumably due to the presence of a cement residue in the reclaimed and recycled material which enhances the cementitious qualities of the concrete.

It will be apparent to one skilled in the art that apparatus 10 provides a comparatively compact form of mobile crushing plant that can be readily transported and utilized at building sites. It will also be apparent to one skilled in the art that modifications may be made to the illustrated flexible embodiment without departing from the spirit and scope of the invention as defined by the Claims.

The embodiments of the invention in which an exclusive property or privilege is claimed are as follows:

1. A mobile crushing plant, comprising:

a. a trailer having a deck;

b. a crusher support frame secured to the deck;

c. a primary crusher mounted on the crusher support frame in an elevated position above the deck, the primary crusher having an inlet and an outlet;

d. a feed hopper assembly mounted to the deck, the feed hopper having an inlet and an outlet, a feed conveyor extending from the outlet of the feed hopper to the inlet of the primary crusher, thereby providing a continuous supply of waste material to the inlet of the primary crusher;

e. a screening assembly support frame secured to the deck;

f. a secondary crusher mounted to the deck adjacent the screening assembly support frame, the secondary crusher having an inlet and an outlet;

g. a top screen and a bottom screen mounted on the screening assembly support frame in an elevated position above the deck, the top screen and bottom screen being arranged with the top screen positioned directly above the bottom screen such that small pieces of waste material pass through both top and bottom screens, the top and bottom screens being disposed at an angle such that pieces of concrete too large to pass through the top screen roll down the angled top screen to a drop off area, and pieces of waste material small enough to pass through the top screen but too large to pass through the bottom screen roll down the angled bottom screen to the inlet for the secondary crusher thereby receiving secondary processing;

h. a first conveyor extending from the outlet of the primary crusher to above the top screen, whereby crushed pieces of waste material exiting through the outlet of the primary crusher are conveyed to the top screen;

i. a second conveyor extending from the drop off area to the inlet of the feed hopper, whereby pieces of concrete too large to pass through the top screen are reprocessed through the primary crusher; and j. an output conveyor disposed below the bottom screen and below the outlet of the secondary crusher, whereby waste materials that pass through the bottom screen or that pass through the secondary crusher are conveyed to a collection area.

* * * * *